US005201787A

United States Patent [19]

LaLonde et al.

[11] Patent Number: 5,201,787

[45] Date of Patent: Apr. 13, 1993

[54] TRIM SYSTEM FOR SUSPENSION CEILINGS

[75] Inventors: Paul D. LaLonde, Avon; J. Wesley Sroub, Parma; James A. Fletterick, Olmsted Falls, all of Ohio

[73] Assignee: USG Interiors, Inc., Chicago, Ill.

[21] Appl. No.: 819,272

[22] Filed: Jan. 10, 1992

Related U.S. Application Data

[63] Continuation-in-part of Ser. No. 708,975, May 31, 1991.

[51] Int. Cl.[5] ..... E04B 5/52

[52] U.S. Cl. ..... 52/484; 52/488; 52/475; 52/664; 52/631; 52/DIG. 8

[58] Field of Search ..... 52/484–489, 52/475, 656, 476, 477, 664–667, 631, DIG. 8, 284, 288

[56] References Cited

U.S. PATENT DOCUMENTS

| | | | |
|---|---|---|---|
| 2,915,150 | 12/1959 | Weidler | 52/631 X |
| 3,562,973 | 2/1971 | Gangemi | 52/631 X |
| 4,535,580 | 8/1985 | Shirey . | |
| 4,744,188 | 5/1988 | Ahren . | |
| 4,872,296 | 10/1989 | Janni | 52/631 X |
| 5,031,377 | 7/1991 | Beckmann | 52/631 |

*Primary Examiner*—Richard E. Chilcot, Jr.
*Attorney, Agent, or Firm*—Pearne, Gordon, McCoy & Granger

[57] ABSTRACT

A support system for trimming exposed edges of suspension ceilings provides a trim strip mounting clip which mounts on the bulb of an adjacent grid tee member and provides a face portion which snaps into and locks with a channel-shaped trim strip. The connector clip supports the trim strip from the adjacent grid members without any exposed fasteners and provides an uninterrupted finished edge appearance. Several embodiments of connector clips are illustrated, one of which provides a support portion pivotally connected to a face portion so that trim strips can be mounted on adjacent grid members in positions parallel to the adjacent grid members and at angles relative thereto. Also disclosed are splice plates which bridge between abutting ends of trim strips to lock such abutting ends in proper alignment. Such splice plates can be used with straight or curved trim strips and can also be used at inside corners.

14 Claims, 13 Drawing Sheets

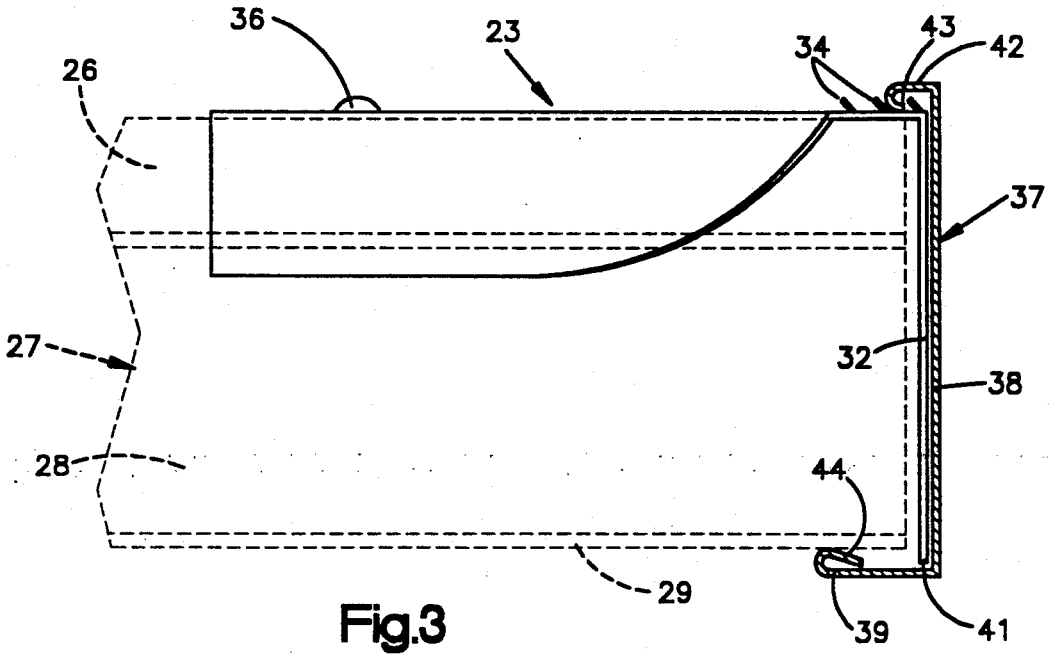
Fig.3
Fig.4
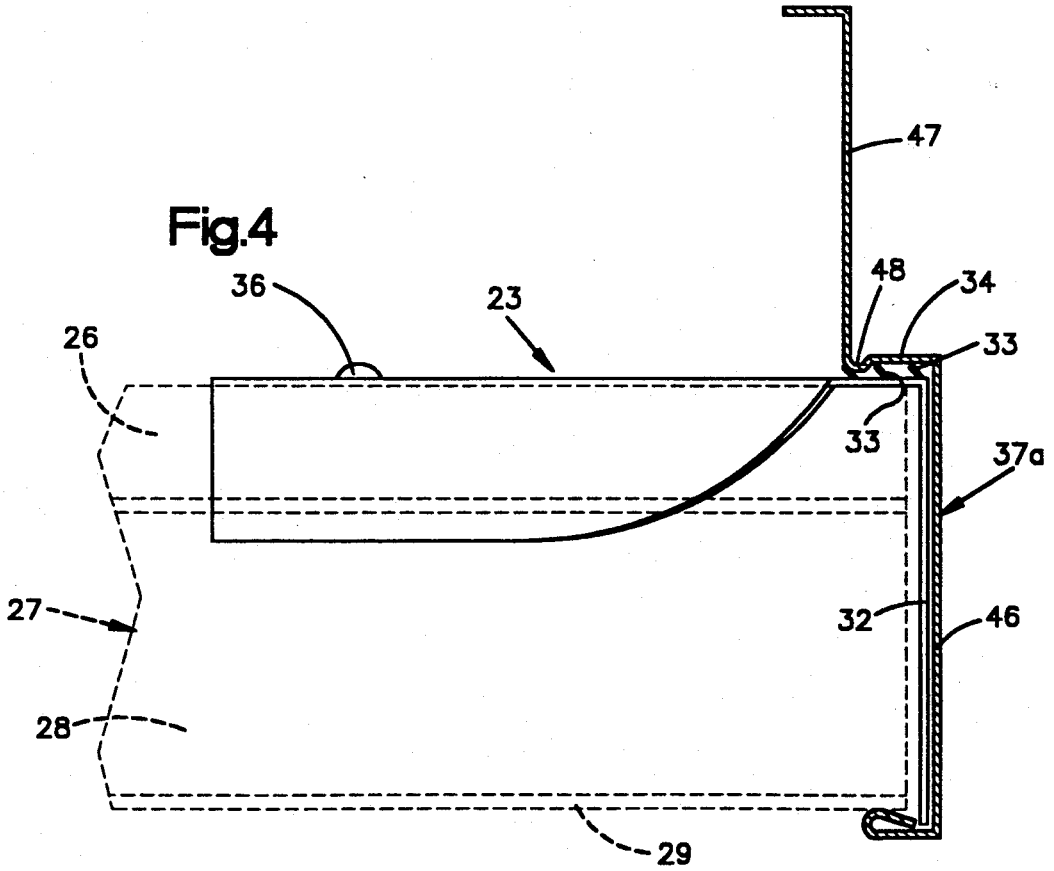

141
142
143
143a
144
145
146
147
147a
148
148a
148b
23
24

TRIM SYSTEM FOR SUSPENSION CEILINGS

BACKGROUND OF INVENTION

This is a continuation-in-part of the copending application Ser. No. 07/708,975, filed May 31, 1991.

This invention relates generally to suspension ceilings and more particularly to a novel and improved system for providing trim along exposed edges of such suspension ceilings.

PRIOR ART

In some instances, suspension ceilings have exposed edges which require trim if a neat and finished appearance is required. For example, some suspension ceilings are provided with islands which are suspended at levels different than and usually below the adjacent ceiling surface. Such islands have exposed edges spaced from other portions of the ceiling and the walls. If such exposed edges are not trimmed in some manner, a very unfinished appearance results.

In other instances, the ceiling may be terminated at a location spaced from the wall or at a location where an adjacent wall does not exist. Here again, unless a finishing trim is provided, an unfinished edge may be visible.

In the past, exposed edges have generally been trimmed in one of two ways. One such method of trimming the edge involves the construction of a soffit-type stub wall extending down from the building structure above to the level of the ceiling edge. The suspension ceiling is then installed in the typical manner extending to such stub wall. In such method the soffit itself, which must be separately constructed and supported by the building structure, provides the trim for what would be otherwise an exposed edge of the suspension ceiling. In the other method a trim strip which may be, for example, a channel or L-shaped strip is secured to the lower face of the grid by rivets or screws. Both of these methods are labor intensive and therefore costly. Further, in the latter method, the rivets or screws are exposed to view and therefore detract from the finished appearance of the ceiling.

It is also known to provide a trim strip as illustrated in the U.S. Pat. No. 4,744,188 (assigned to the assignee of this invention). Such trim strip is generally channel-shaped and provides a lower leg which fits under the flange of the grid tee. The upper leg of such channel is secured to the bulb of the grid tee. Such trim strips can only be installed along exposed edges of the ceiling where a grid tee member extends parallel to the edge and cannot be installed at angles to the ceiling grid, nor at locations where only the ends of grid tees exist at the exposed edge. Such patent is incorporated by reference in its entirety.

SUMMARY OF THE INVENTION

The present invention provides a cost efficient system for mounting edge trim along exposed edges of suspension ceilings. With such system, the trim is supported and positioned by the ceiling grid itself, therefore it is not necessary to construct separately supported structures to conceal the edge of the ceiling as required in the first method described above.

Further, the system provides a connector which supports the trim from the ceiling grid without any exposed fasteners so that the finished appearance of the trim is not degraded by any exposed fasteners or the like.

Still further, the trim can be installed and supported by the grid members in positions in which the trim extends parallel to or at an angle with respect to the support grid.

In a first illustrated embodiment a simple, low cost connector clip is provided with a channel-shaped support portion which fits over the bulb of a suspension ceiling grid tee and also provides a face portion which snaps into a channel-shaped trim strip. Such connector is easily installed at the ends of the grid tees along the exposed edge of the suspension ceiling. The completion of the trim installation is accomplished by merely snapping a trim channel onto the face portion. This illustrated embodiment may be used when the trim strip extends perpendicular to the supporting grid tee and the trim has a height substantially equal to the height of the grid tee.

In a second embodiment, the connector clip is again provided with a channel-shaped support portion which again fits over the bulb of a typical grid tee. In this embodiment a face portion is connected to the support portion by a connection which allows the face portion to rotate relative to the support portion with a pivot-type movement. Here again, the face portion is structured to connect with a trim strip by a simple snap in connection.

The face portion, because of the pivot-like movement, permits this embodiment to be connected with trim extending parallel to the supporting grid tees as well as at angles relative thereto. In fact, with this embodiment the connector can be used to connect with straight or curved trim strips extending at all angles relative to the associated grid tee from parallel to perpendicular. Further, with this embodiment the face portion can be sized to connect with narrow trim strips having a width substantial equal to the height of the grid tees or with trim strips having a substantially greater height.

A third embodiment provides a simple connector clip for connecting trim strips parallel to the supporting grid tee. This embodiment can connect with trim strips having a height substantially greater than the height of the grid tee.

Another aspect of this invention involves a novel and improved splice plate for connecting the adjacent ends of trim strip. One illustrated embodiment can be used to interconnect aligned trim strips as well as trim strips forming an inside corner. In another embodiment, the splice plate can also be used to interconnect curved trim strips.

These and other aspects of this invention are illustrated in the accompanying drawings and are more fully described in the following specification.

BRIEF DESCRIPTION OF THE DRAWINGS

FIG. 3 is a side elevation of the trim mounted clip illustrated in FIG. 2 with the grid on which the clip is mounted illustrated in phantom;

FIG. 4 is a side elevation of the trim mounting clip of FIG. 2 with a relatively wide trim strip mounted thereon;

DETAILED DESCRIPTION OF THE DRAWINGS

Figure 1:
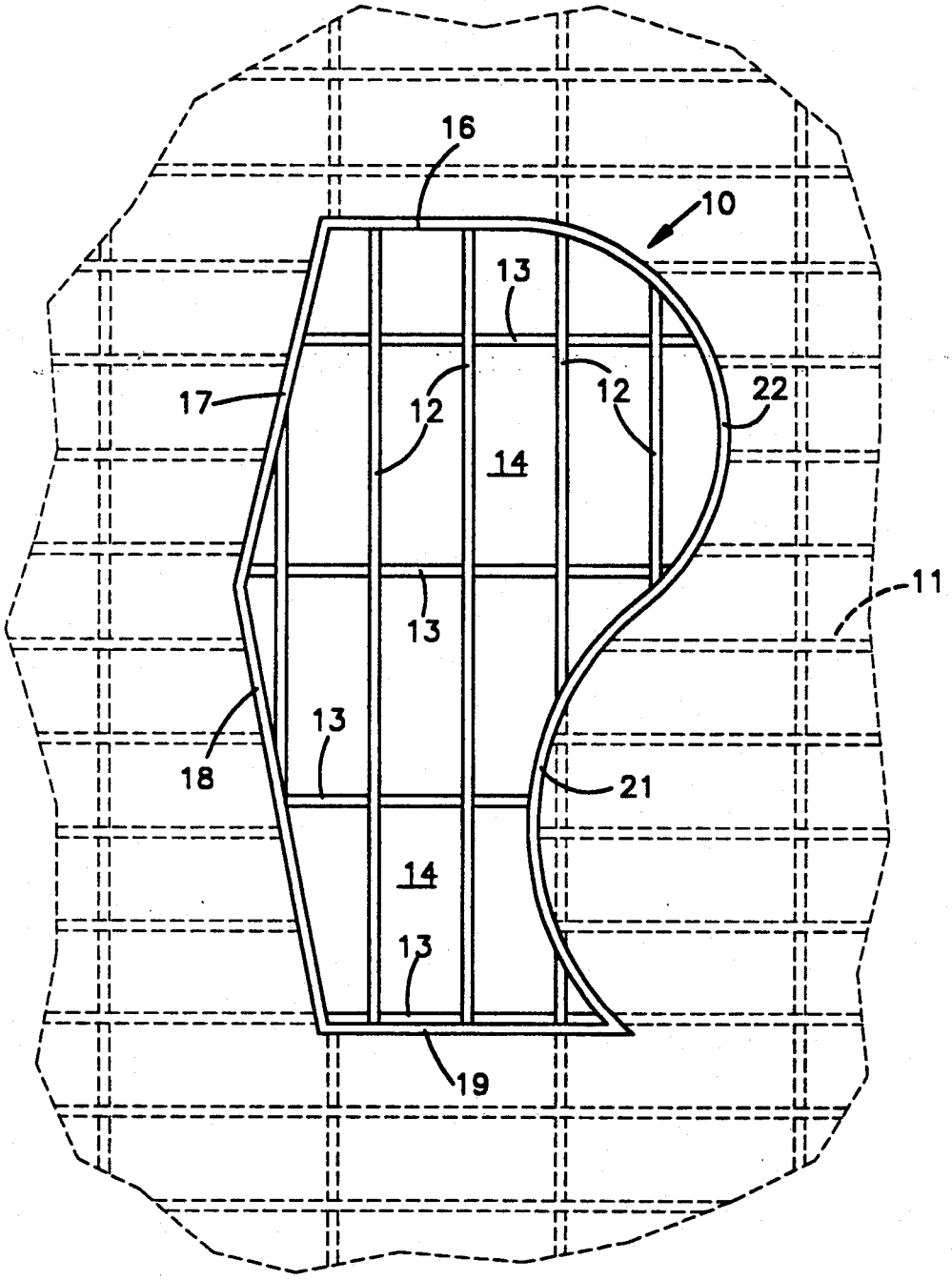
FIG. 1 is a view from below of a suspension ceiling having an island suspended below a main suspension ceiling and provided with trim along the edges thereof mounted in accordance with the present invention.

FIG. 1 illustrates an island 10 positioned below the remainder of a suspension ceiling 11. The suspension ceiling is illustrated in dotted lines to emphasize the fact that the island is displaced below the surface of the ceiling.

The particular island 10, like the ceiling 11, is provided with main grid tees 12 and cross tees 13 which are connected together in the usual manner to form panel receiving openings 14. The entire island is enclosed within channel shaped trim strips which provide a finished edge for the island. In this particular instance a portion of the island is enclosed by straight trim strips 16, 17, 18 and 19. The remainder of the island is enclosed within curved trim strips 21 and 22. The trim strip 21 is concavely curved and the trim strip 22 is convexly curved.

All of these trim strips are mounted on the associated main tees 12 and cross tees 13 by trim strip mounting clips in accordance with the present invention. In FIG. 1 such mounting clips are not visible because they are hidden by the panels and the trim. Further, the mounting clips do not require any exposed fasteners so the trim strips form a finished border around the entire island.

Figure 2:
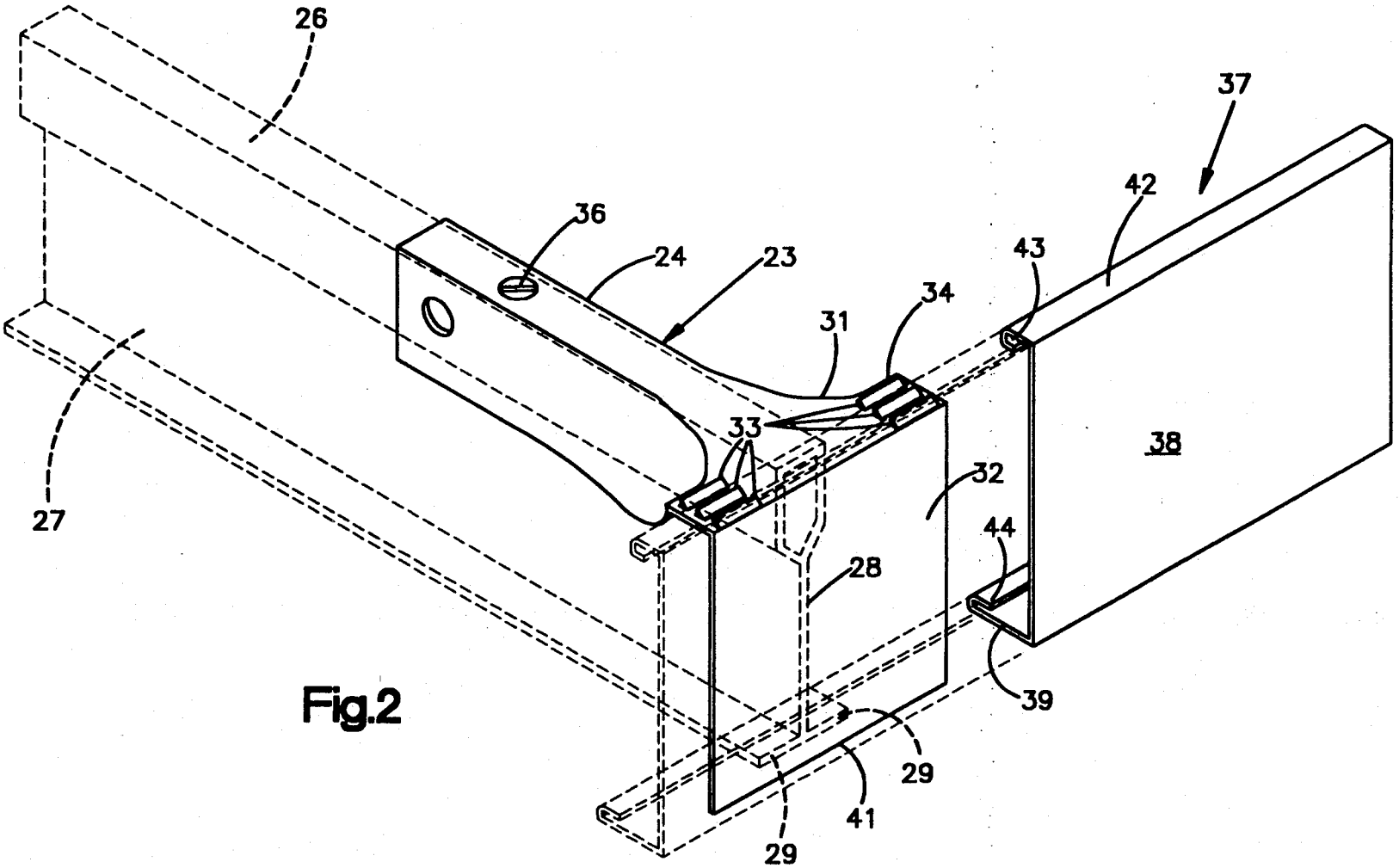
FIG. 2 is a perspective view of a trim mounting clip in accordance with the first embodiment of this invention and one type of trim channel that may be mounted on such clip.
Figure 5:
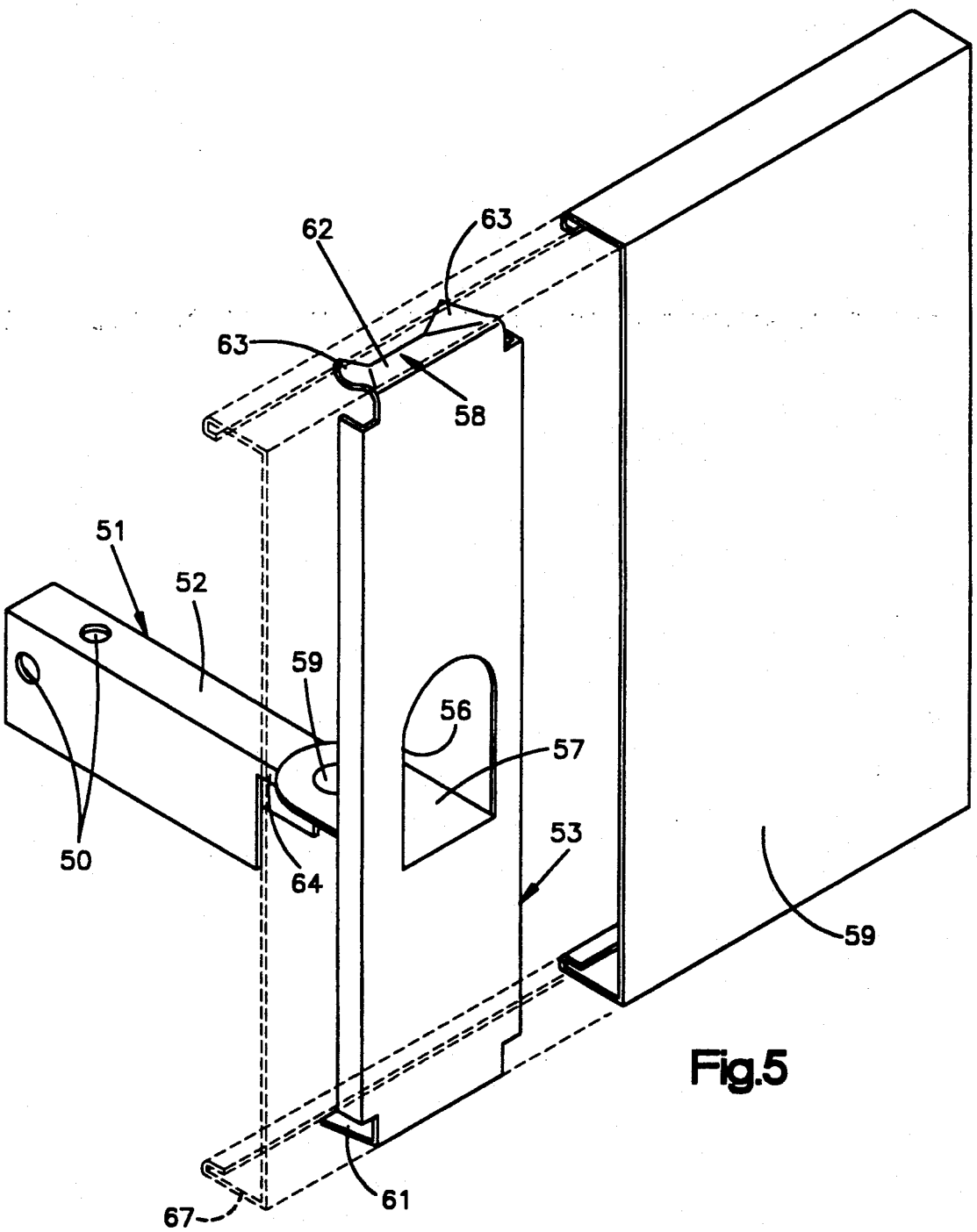
FIG. 5 is a perspective view of a second embodiment trim mounting clip in which the face portion of the clip on which the trim is actually mounted is pivotally connected to the mounting portion allowing mounting of a trim strip which extend at various angles relative to the supporting grid tee.

FIGS. 2 through 4 illustrate a first embodiment of a trim strip mounting clip 23 in accordance with this invention. The mounting clip 23 provides a channel-shaped or inverted U-shaped support portion 24 which fits over the bulb 26 of an associated grid tee 27. Such grid tee, like all of the grid tees illustrated in the Various figures, provides a hollow, generally rectangular bulb 26 at the upper edge of a web 28 and oppositely extending panel supporting flanges 29 along the lower edge of the web 28.

A transition portion 31 joins the support portion 24 to a planar face portion 32. Extending from the upper surface of the transition portion 31 are three pairs of locking tabs 33 which are inclined upwardly and rearwardly to locking edges 34. Typically, the support portion 24 is secured to the bulb 26 by a screw or rivet fastener 36 which ensures that the mounting clip 23 cannot move relative to the associated grid tee 27. Preferably, the support portion is punched to provide an opening on the top and the side so that a fastener 36 can be installed in either position. For example, fasteners 36 are installed on the side of the bulb when ceiling clearance prevents them from being installed on the top.

A channel-shaped trim strip 37 is snapped into position on the mounting clip 23 and is therefore secured to and supported by the associated grid tee members. Such trim strip 37 provides a planar portion 38 which fits against the face portion 32 of the mounting clip. A lower flange 39 fits beneath the bottom edge 41 of the face portion and an upper flange 42 fits back along the upper surface of the transition portion 31 of the mounting clip. The upper flange 42 is provided with a hem 43 which locks against one of the pair of locking tabs to hold the upper flange tightly against the upper end of the face portion. Similarly, the lower flange is usually provided with a hem 44, however, such hem need not engage the back side of the lower edge 41 of the face portion 32 since the engagement between the upper hem and the locking edge 34 is spaced back from the face portion and produces a force tending to maintain the lower end of the trim strip tight against the face portion.

In FIGS. 3, 4, and some of the other FIGS., clearances are shown between the mounting clip and the various portions of the trim strip for purposes of illustration. However, in practice, the trim strips are dimensioned to tightly engage the face portion 32 of the mounting clip, in fact, an interference fit is desired so that once the trim strip is snapped into its mounted position, it is tightly held by the mounting clip. The lower flange 39 extends under the adjacent portion of the panel supporting flanges 29. Because a hem 44 is provided on the lower flange 39, all raw edges are concealed.

FIG. 4 illustrates the manner in which a trim strip 37*a* having a height exceeding the height of the grid tee 27 may be mounted on a mounting clip 23. In this instance, the trim strip provides a lower portion 46 which snaps onto the face portion of the mounting clip 23 and an upper portion 47 which is rearwardly spaced and extends above the grid tee. In this illustrated trim strip 37*a* a bead 48 is provided at the lower end of the upper portion to lock with the locking tabs. Here again, the mounting of the trim strip is accomplished by merely snapping the trim strip onto the associated mounting clip 23.

The mounting clip 23 can only be used at locations where the trim strip must extend perpendicular to the associated grid tee and the grid tee ends at an off-module position. For example, such a mounting clip 23 could typically be used to connect the trim portion 16 illustrated in FIG. 1 to the ends of the main runners 12. Because the connector 23 is formed from a single piece of sheet metal and is very low in cost, its use is preferred in instances in which the trim strip extends perpendicular to the grid tee and is located at an off-module position.

Figure 6:
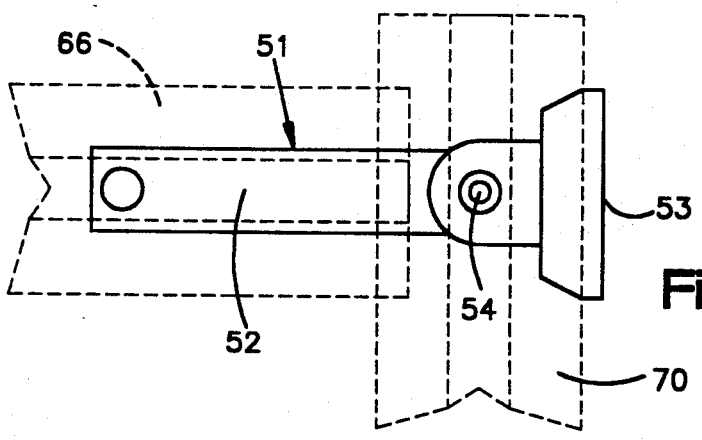
FIG. 6 illustrates the mounting clip of FIG. 5 mounted on a grid at a intersection between perpendicularly extending grid tee members.
Figure 7:
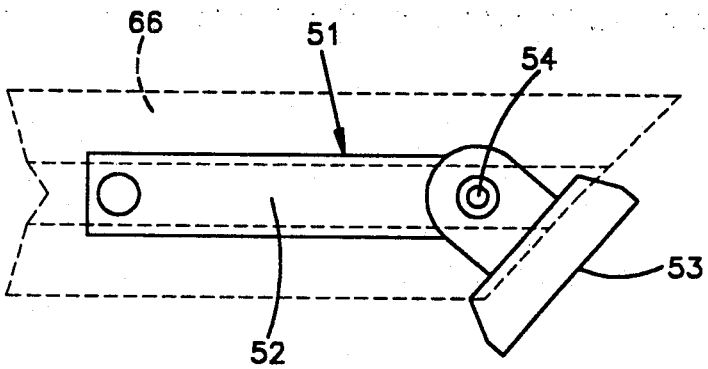
FIG. 7 illustrates the trim mounting clip of FIG. 5 positioned to support a trim strip extending at an angle relative to the grid tee member.
Figure 8:
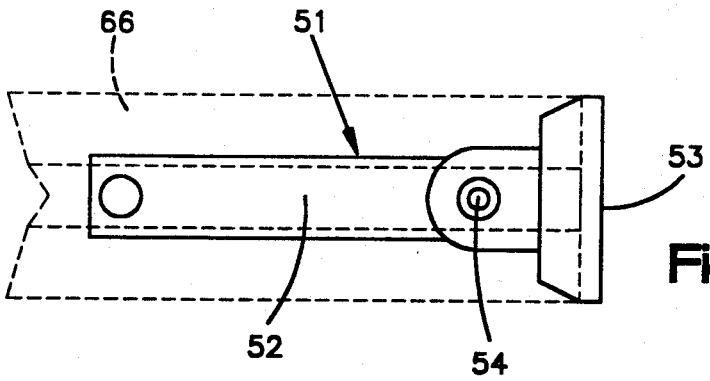
FIG. 8 illustrates the trim strip mounting clip mounted on the end of a grid tee positioned to support a trim strip extending perpendicular to the grid tee.
Figure 9:
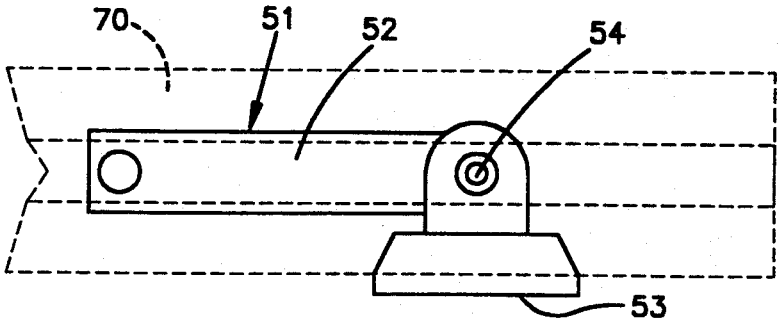
FIG. 9 is a view of the trim strip mounting clip in position to support a trim strip extending parallel to the supporting grid tee.

FIGS. 5 through 14 illustrate variations in structure and use of a second embodiment mounting clip. Such mounting clip may be used to connect straight or curved trim strips of various heights. Further, the mounting clip can be used with trim strips which extend parallel to the supporting grid tee or at angles relative to the supporting grid tee. In this embodiment, all of the variations of the mounting clip 51 provide a support portion 52 which is again channel-shaped or shaped or as an inverted "U" so as to fit down over the bulb of an associated grid tee in a manner similar to the support portion of the first embodiment. A pair of openings 50 are provided in the support portion 52 through which fasteners can be installed. However, in this embodiment the face portion 53 is connected to the support portion by a rivet 54 which permits pivotal movement of the face portion relative to the support portion through a full 180°. Therefore, the face portion 53 can extend perpendicular to the supporting grid tee as illustrated in FIGS. 6 and 8, at an angle relative to the supporting grid tee as illustrated in FIG. 7, or parallel to t he supporting grid tee as illustrated in FIG. 9. In the variation illustrated in FIGS. 5 through 12, the face portion 53 is cut out at 56 to provide a laterally extending tongue 57. The tongue 57 extends rearwardly to a position in which it overlays the adjacent end of the support portion and is connected thereto by the rivet 54.

The upper end of the face portion 53 is formed with a rearwardly extending flange 58 which snaps into and locks with the associated trim strip 59. Similarly, the lower end of the face portion 53 is provided with a rearwardly extending flange 61 which snaps into and locks with the lower end of the trim strip 59. Preferably, the upper flange 58 is provided with a recessed, central portion 62 and a pair of upwardly extending lock portions 63. With such structure, a screwdriver or the like can be inserted between the upper flange of an installed trim strip 59 and the recess 62 to pry the upper flange of the trim strip up, clear of the locking projections 63, when it is desired to remove the trim strip from its mounted position.

Figure 10:
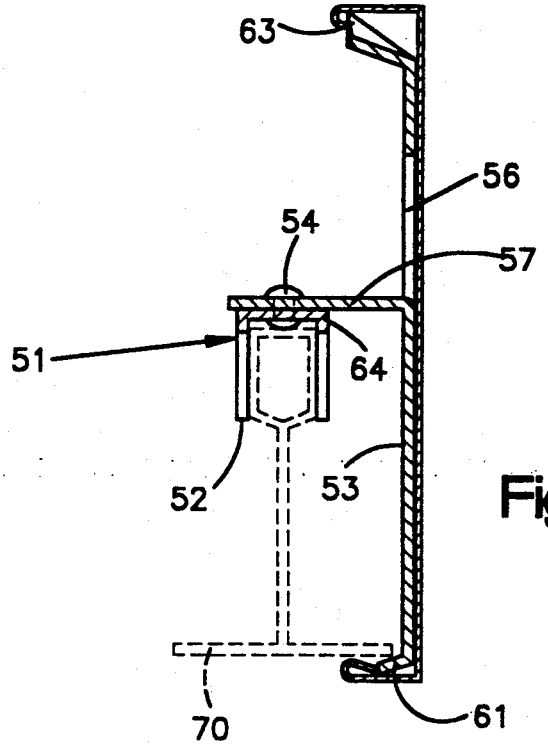
FIG. 10 is a vertical cross section illustrating the trim strip mounting clip supporting a trim strip extending parallel to the grid tee and corresponds to the position illustrated in FIG. 9.
Figure 11:
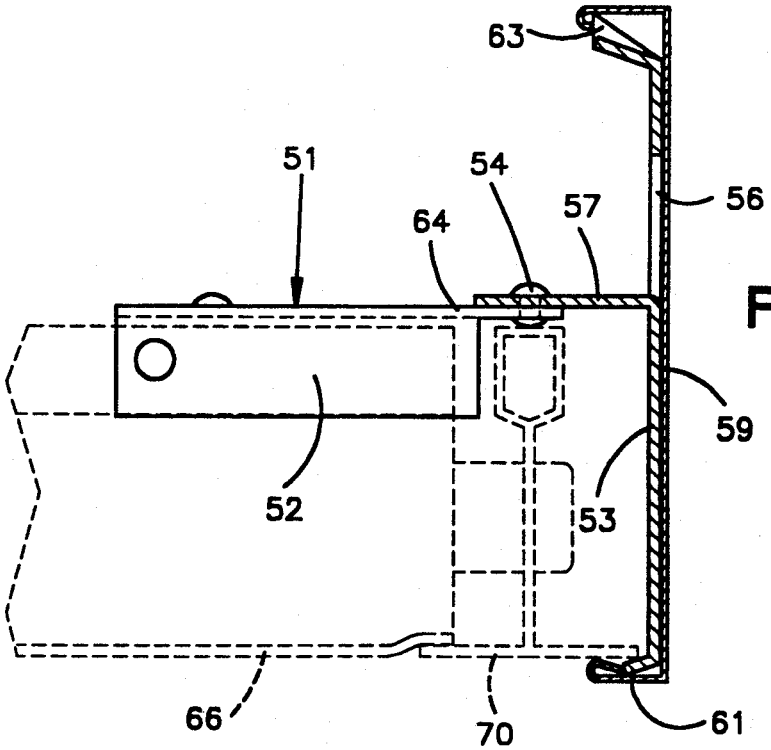
FIG. 11 corresponds to FIG. 6 and illustrates the trim strip mounting clip at an intersection and supporting the trim strip extending parallel to the adjacent grid tee.

The support portion is formed with an end extension 64 which extends beyond the channel-shaped part thereof so that the mounting clip 51 can be installed at an intersection as illustrated in FIGS. 6 and 11. In such instance, the support portion 52 is positioned on a grid member 66 so that the extension 64 extends beyond the end thereof and positions the pivot fastener 54 above the bulb of the grid tee 67. Further, the tongue 57 is sized so that it positions the face portion 53 beyond the adjacent edge of the flange of the grid 70. Therefore, the trim strip 59 is properly positioned to extend parallel to the grid tee 70 even though it is supported by the grid tee 66 and extends perpendicular to the grid tee 66. In FIG. 10 however, the support portion 52 of the mounting clip 51 extends parallel to the adjacent grid member 70 since it is mounted at a location spaced from an intersection. In this mounting, the face portion 53 is pivoted to a position perpendicular to the support portion 52 and the face portion is again properly positioned for supporting a trim strip 59 parallel to the grid tee 67.

The length of the tongue 57 is selected so that when the pivot 54 is directly over the bulb of an adjacent grid tee and the face portion 53 is positioned parallel to such grid tee, the face portion is properly positioned to receive the trim strip. In the illustrated embodiment, the planar surface is spaced from the pivot axis by a distance slightly greater than the width of one of the panel supporting flanges of the grid tee.

The mounting clip, because of the pivoted connection between the face portion and the support portion, can be utilized to support trim strips extending parallel to the supporting grid tee and at all angles between the perpendicular and parallel position. For example, the mounting clip 51 can be used to connect and support any of the trim strips illustrated in FIG. 1.

When mounting the trim strip 16 the mounting portion is positioned with respect to the end of the adjacent grid tees so that the trim strip 16 extends perpendicular to and encloses the end of the associated grid tee in the manner illustrated in FIG. 8. When supporting the angled trim strip 17 and 18, the face portion is pivoted with respect to the support portion to properly align with such trim strips. When supporting the trim strip 19, the mounting clip can be mounted at intersections as illustrated in FIG. 11 or at locations spaced from the intersections as illustrated in FIG. 10. When supporting the curved trim strips 21 and 22, the face portion is appropriately pivoted relative to the supporting grid member to accommodate the particular angle at the point of support. In effect, the mounting clip 51 is a universal mounting clip which can be adjusted to support a trim strip in substantially any orientation with respect to the supporting grid tee member.

Figure 12A:
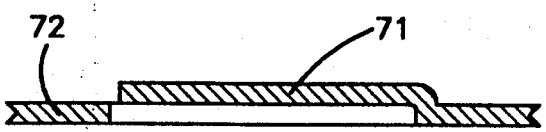
FIG. 12*a* illustrates the tab as initially formed and prior to bending the tab to the position of FIG. 12.
Figure 12:
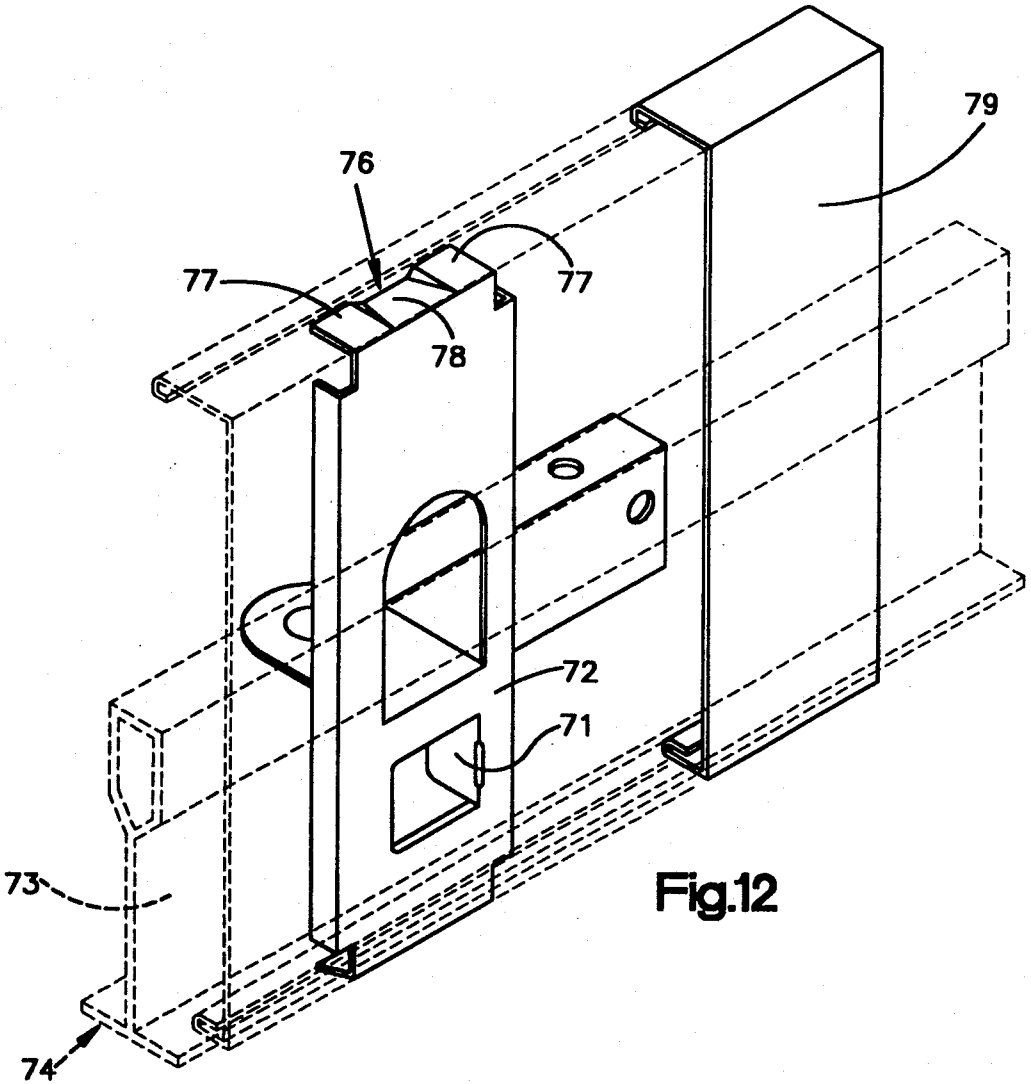
FIG. 12 is a modified embodiment of the trim strip mounting clip of FIGS. 5-11 in which a tab is provided to engage the side of the web of the supporting grid tee when the face portion is pivoted to extend parallel to such grid tee.

FIG. 12 illustrates a variation of the second embodiment. In this variation a second tab 71 is bent back from the face portion 72. This tab 71 is sized and positioned so as to engage with the side of the web 73 of an associated grid tee 74 when the face portion is pivoted to a position parallel to the length of the grid tee 74. This tab provides additional stability. Further, in this variation, the upper flange 76 is modified to provide laterally extending locking edges 77 on either side of the recess 78. This structure provides a greater area of contact with the trim strip 79 than the earlier described flange locking system. Here again the recess permits the insertion of a screwdriver or the like when removal of an installed trim strip is required.

As illustrated in FIG. 12*a*, the tab 71 is lance cut from the face 71 and initially extends parallel to the face portion but is on the back side thereof. When the tab use is not required, it remains in its initial position. However, when the tab use is required, it is merely bent back perpendicular to the face portion as illustrated in FIG. 12.

Figure 13:
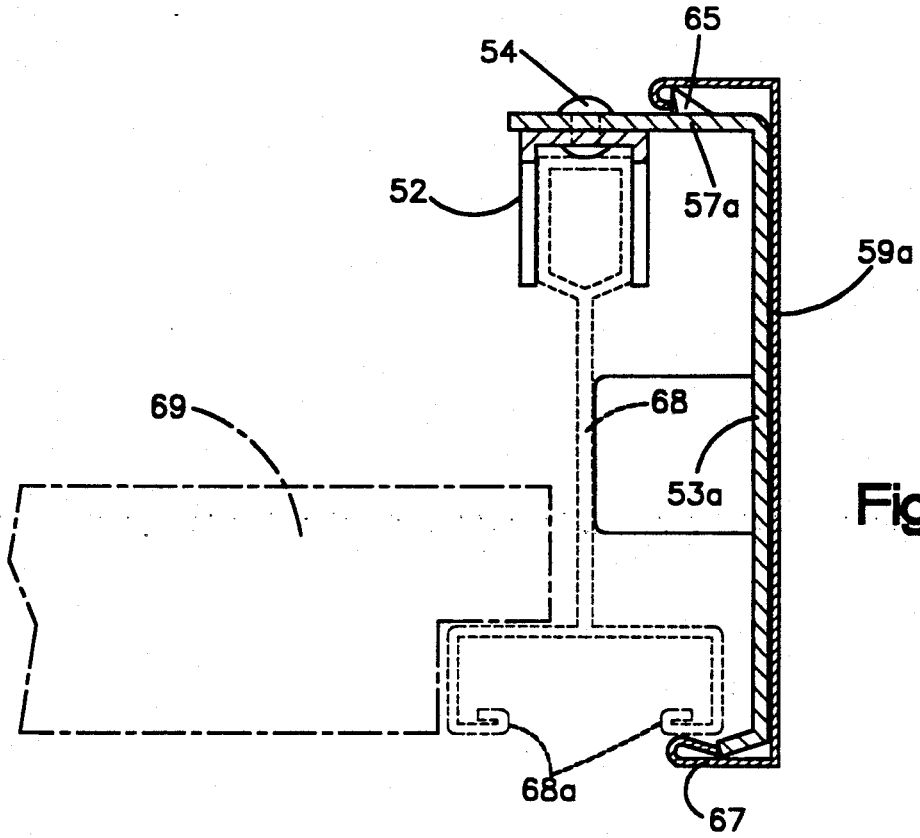
FIG. 13 illustrates the manner in which a trim strip support clip can be installed with a grid tee having a box-shaped panel supporting flange structure which is open on the lower side thereof.
Figure 14:
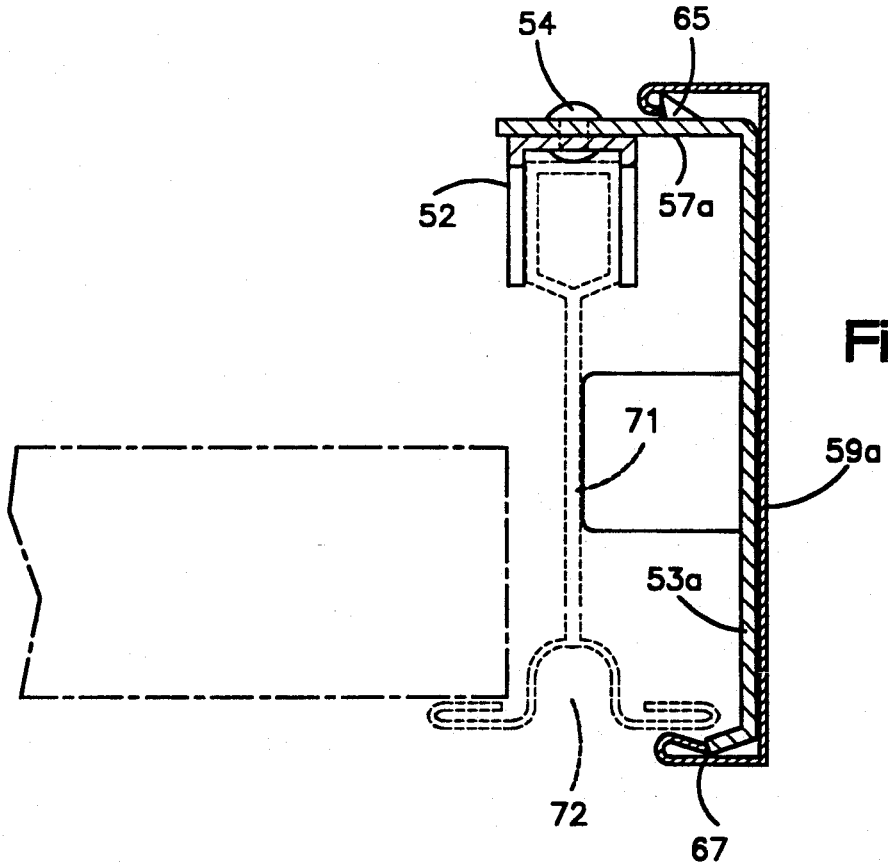
FIG. 14 is a view similar to FIG. 13 but illustrating the manner in which the same trim strip and support clip can be applied to a grid tee having a hat-shaped panel supporting flange.

FIGS. 13 and 14 illustrate another modified version of the second embodiment mounting clip. In this modified version, the trim strip is sized to have a height substantially equal to the height of the associate grid tee. In such instance, the face portion 53*a* is bent to extend laterally providing a lateral flange 57*a* corresponding to the tongue 57 of the version of FIG. 5. Such flange is connected by pivot fastener 54 to the support portion 52. In this instance, a locking tongue 65 is bent out from the flange 57*a* to lock with the upper flange of a trim strip 59*a*.

The various proportions of the mounting clips are selected so that the lower flange 67 of the trim strip 59 or 59*a* will extend a short distance under the lower surface of the flange of a typical grid tee and also so that it will be properly positioned with respect to other forms of grid tees. For example, in FIG. 13, the grid tee 68 is provided with a box-like lower flange which is open on the bottom side.

The grid tee 68 is of the type illustrated in the U.S. Pat. No. 4,535,580 which patent is incorporated herein by reference. Such grid tees provide gaps in the lower inwardly extending lips 68*a*, as described in such patent, so that a "miter" type joint is provided at intersections. Since such gaps would be exposed on the outer side where no intersecting grid tee exists, the lower flange 67 of the trim strip is proportioned and positioned to extend into exact alignment with the inner edge of the outer lip 68*a* as illustrated in FIG. 13. Therefore, the gaps are concealed from view. The tab 71 functions to insure this precise positioning of the flange 68*a*.

The same mounting clip and trim strip 59*a* can also be used with grid tees 71 as illustrated in FIG. 14. Such grid tees provide a hat-shaped flange structure having an upwardly extending central channel 72. In this instance, the lower flange 67 of the trim strip 59*a* again, extends inwardly along the adjacent flange surface but terminates back from the channel 72.

With this pivoted embodiment, the face portion can be made of substantially any height to connect with and support trim strips of various heights. Further, if desired, the face portion can be made wider so as to function as a splice plate at abutting ends of adjacent trim strips.

Figure 15:
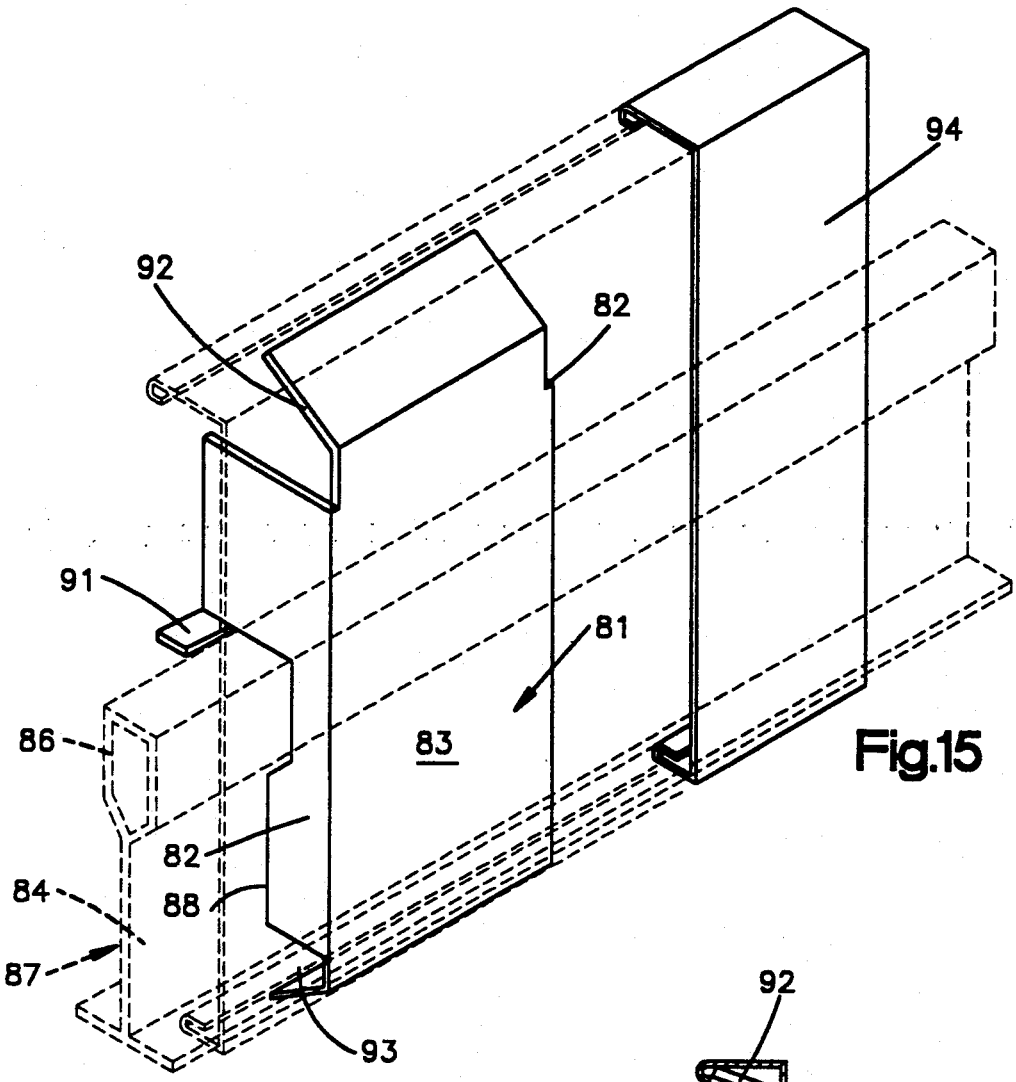
FIG. 15 is a perspective view of another embodiment of a trim strip support clip which is formed of a single piece of sheet metal and may be used to support a trim strip extending parallel to the supporting grid tee.
Figure 16:
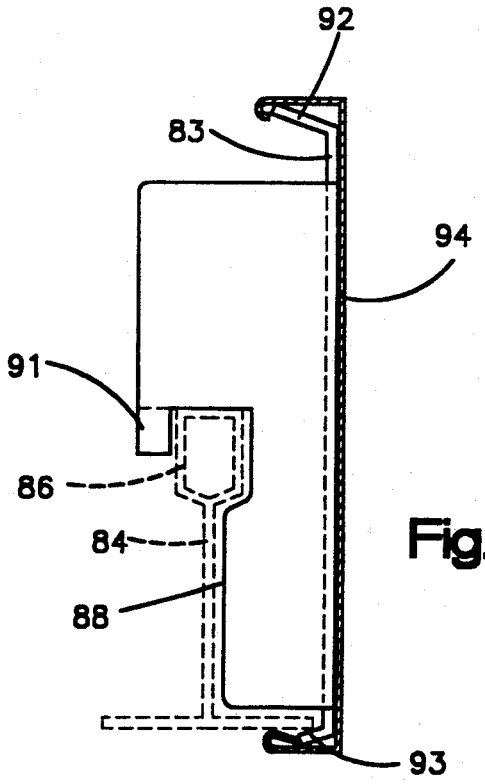
FIG. 16 is an end view of the support clip and trim strip illustrated in FIG. 15.

FIGS. 15 and 16 illustrate a third embodiment of this invention. In this embodiment, the mounting clip 81 is formed of a single piece of sheet metal. A pair of similar legs 82 are bent back from opposite sides of the face portion 83 and are shaped to mate with the web 84 and bulb 86 of the associated grid tee 87. Each leg 82 provides a first edge 88 which engages the side of the web 84. Above the edge 88 the legs are cut to fit around the bulb 86. Tabs 91 are bent up as illustrated in FIG. 15 to allow the mounting clip to be installed on the associated runner 87 and after the clip is positioned, the tabs 91 are bent down to engage the remote side of the bulb, as illustrated in FIG. 16. Here again locking flanges 92 and 93 are provided at the upper and lower ends of the face portion to lock with a channel-shaped trim strip 94. This embodiment can only be used to connect with trim strips extending parallel to the associated grid tee but has the advantage of simplicity since the mounting clip is formed of a simple sheet metal piece bent to produce the required flanges and legs.

FIGS. 17–21 illustrate a novel and improved splice plate for trim strips of the type discussed above. This splice plate may be used to interconnect abutting ends of trim strips both in a condition in which the abutting ends are in alignment, and a condition in which the abutting ends form an inside corner.

Figure 21:
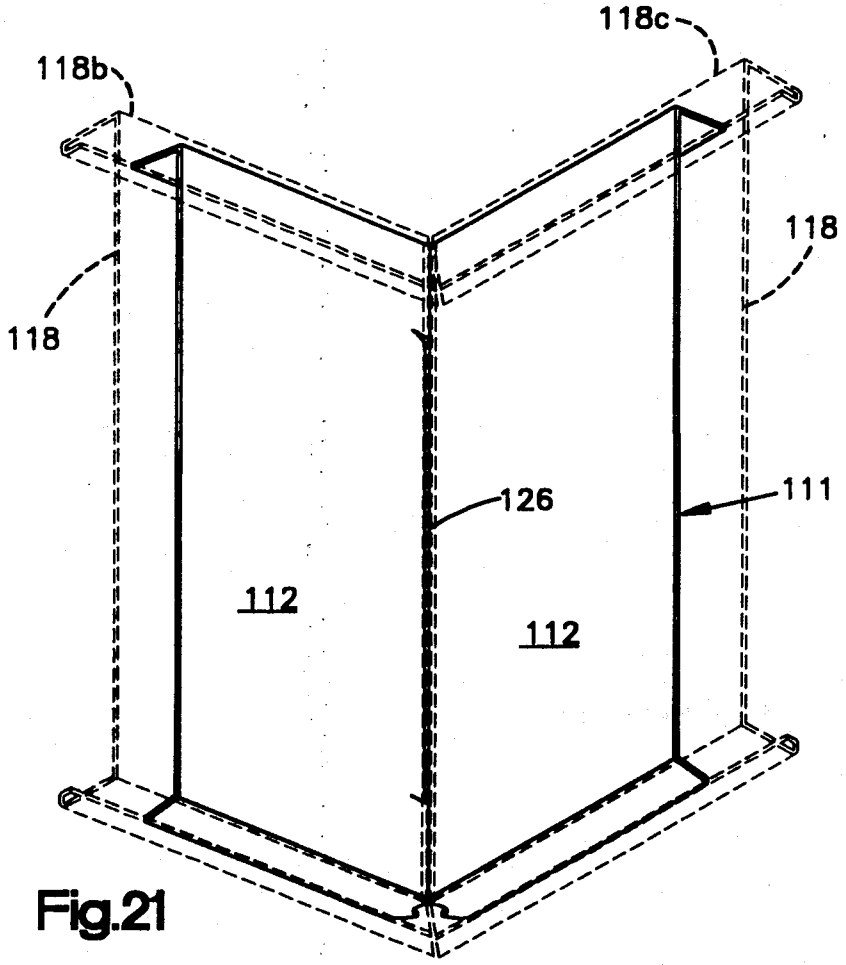
FIG. 21 is a perspective view illustrating the installation of the splice plate at an inside corner formed between two straight trim strips.

Typically, splice plates are not required where the trim strip provides an outside corner, since the upper and lower flanges of the trim strip can be cut to form a miter-type joint. When the trim strip is bent to form the outside corner, the miter-type cut closes to provide a finished appearance. On the other hand, the abutting ends of typical straight trim strips must, on some occasions, be provided at along straight sections and at inside corners. The splice plate of FIGS. 17–21 can be used to interconnect abutting ends of trim strips in either an aligned condition, as illustrated in FIG. 20, or at an inside corner, as illustrated in FIG. 21.

Figure 18:
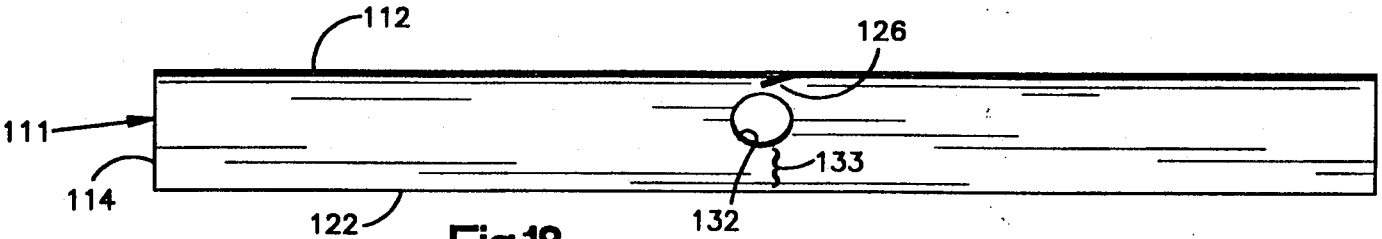
FIG. 18 is a section taken along 18—18 of FIG. 17.
Figure 17:
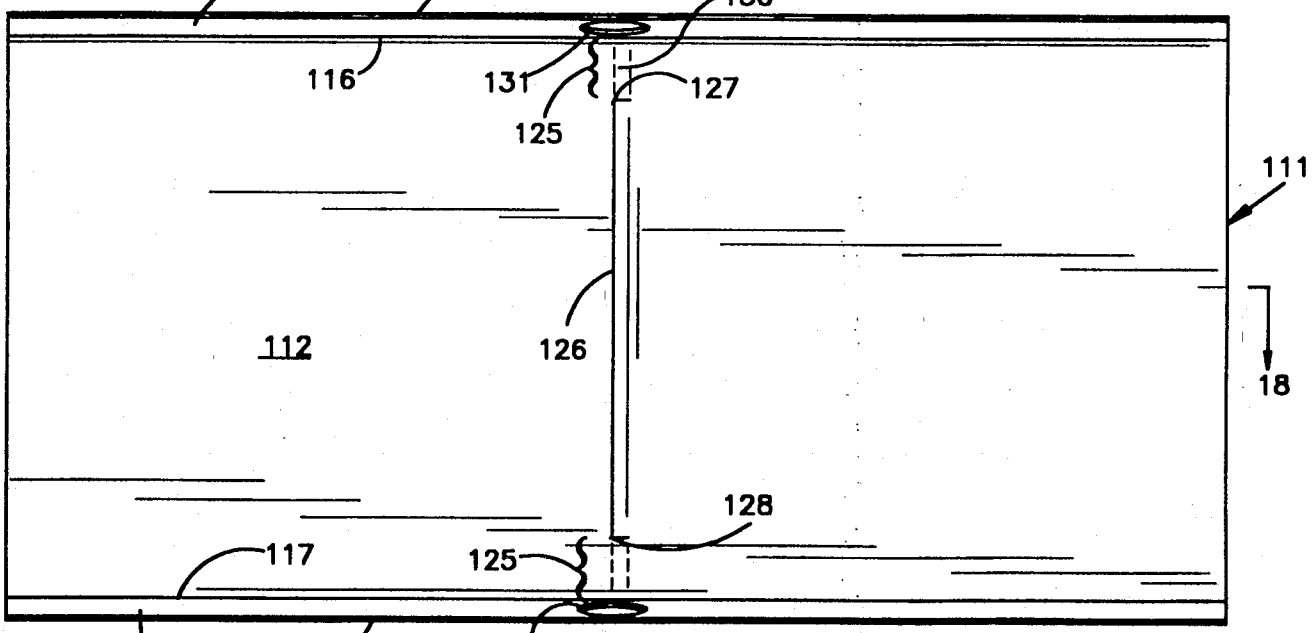
FIG. 17 is a side elevation of a splice plate which may be used to interconnect abutting ends of straight trim strips in either an aligned position or at an inside corner.
Figure 19:
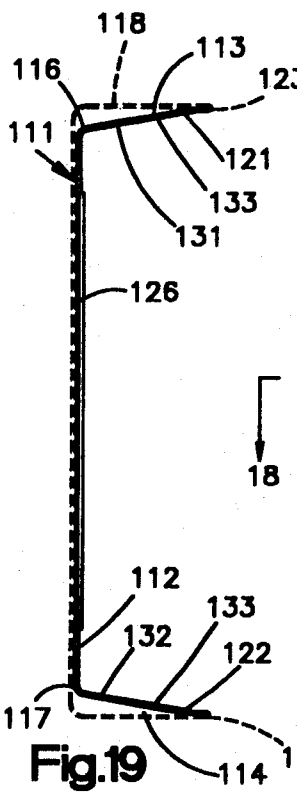
FIG. 19 is a section taken along 19—19 of FIG. 17 also illustrating an associated trim strip mounted on the splice plate.
Figure 20:
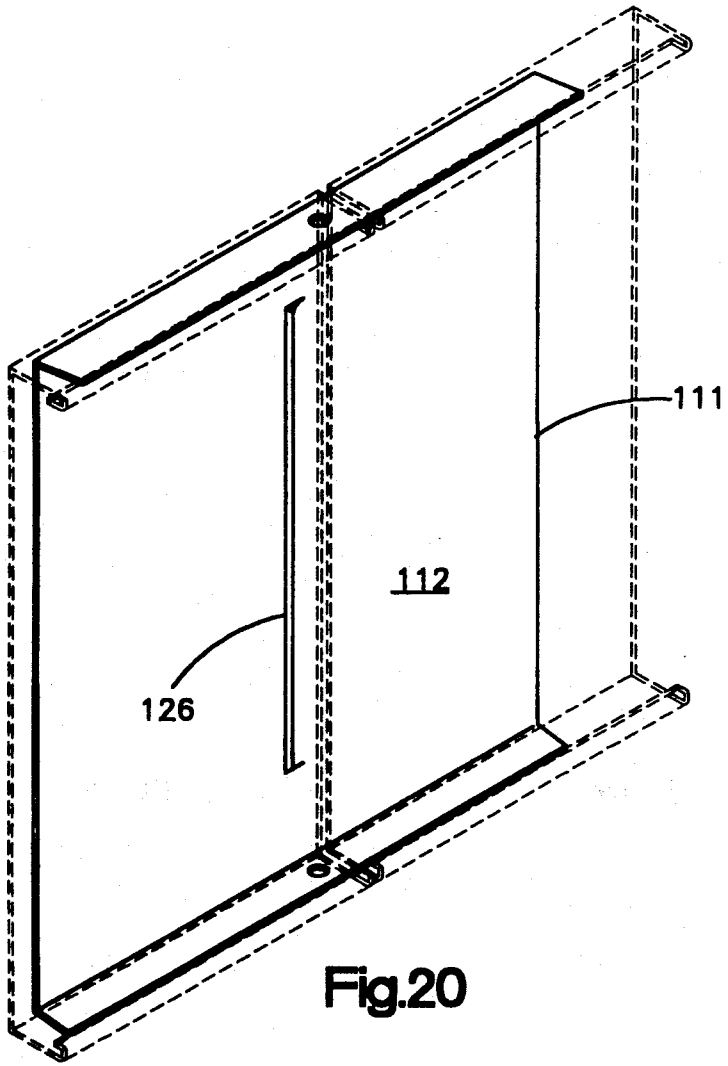
FIG. 20 is a perspective view illustrating the splice plate of FIGS. 17-19 installed and interconnecting aligned straight trim strips.

Referring now to FIGS. 17–19, the splice plate 111 is channel-shaped, as best illustrated in FIG. 19, and provides a central planar face portion 112 and opposed laterally extending flanges 113 and 114 extending from the opposite edges 116 and 117 of the face portion. The dimensions of the splice plate face portion and flanges is arranged so that the splice plate can be snapped into a channel-shaped trim strip 118, as illustrated in FIG. 19. In such position, the edges 121 and 122 snap in behind the adjacent hems 123 and 124 of the trim strip 118 to provide an interlocking connection with the trim strip 118.

The face portion 112 is also formed with a laterally extending lance cut 126 which extends perpendicular to the length of the splice plate to ends 127 and 128 inwardly spaced from the associated edges 116 and 117. Therefore, the face portion provides a continuous uninterrupted section 125 extending past the lance cut 126 at both ends of the lance cut. This lance cut creates a bend line 130 along which the splice plate is bent when it is used to interconnect the abutting ends of trim strips forming an inside corner.

In addition, the two flanges 113 and 114 are formed with openings 131 and 132, respectively, which are in alignment with each other as well as in alignment with the lance cut 126 and bend line 130. These openings are spaced from the associated edges 121 and 122 of the flanges as best illustrated in FIG. 18. Therefore, each flange 113 and 114 provides a continuous uninterrupted portion 133 extending past the bend line and cooperates with the adjacent uninterrupted sections 125 of the face portion 112 to normally maintain the splice plate in a straight condition.

When the splice plate is used to interconnect the abutting ends of two aligned trim strips 118*a* and 118*a*, as illustrated in FIG. 20, such abutting ends are held in aligned abutting condition since the splice plate forms a bridge between, and locks with the adjacent ends of, the two trim strips. As best illustrated in FIG. 20, it is not necessary to snap the splice plate into the abutting trim strips in a completely central position in which the lance cut bend line extends along the abutting joint. However, even if the splice plate is installed so that the lance cut 126 is in alignment with the abutting joint, the splice plate provides sufficient strength to form a proper interconnection bridging the joint between the two trim strips.

When it is necessary to form an inside corner which is neat in appearance, it is necessary to provide trim strip ends having flanges cut at an angle which is closed when the two abutting trim strips are positioned in abutting relationship, as illustrated in FIG. 21. Therefore, inside corners require a splice plate at the corner to hold the abutting ends of the trim strips in alignment and to hold the angled flanges at such ends in abutting engagement.

When the splice plate is used to form an inside corner, it is merely necessary to cut through the uninterrupted portion 133 from the adjacent edge 121 and 122 to the associated opening 131 and 132. Once such a cut has been made, the splice plate can be easily bent with a sharp corner bend along the bend line 130 formed by the lance cut 126 to an angle matching the angle required for the inside corner. At such corner, the portions of the splice plate between the fold line 130 and the two ends of the splice are respectively snapped into the associated trim strips 118*b* and 118*c*, as illustrated in FIG. 21. The splice plate then provides a bridging interconnection which maintains the abutting ends in proper position with respect to each other.

With this simple splice plate structure, it is possible to use the splice plate both for straight interconnection of trim strips, and connection of trim strips at an inside corner. Splice plates having this general configuration but without the lance cut 126 or the openings 131 and 132 have been used in the prior art to connect aligned channel-shaped members. However, such splice plates could not be used at inside corners.

FIGS. 22–25 illustrate a variation of the splice plate described immediately above. This splice plate 141 is again channel-shaped, providing a central planar face portion 142, again provided with a centrally located laterally extending lance cut 143. Here again, flanges 144 and 146 extend from the opposite edges of the face portion 142 to provide a generally channel-shaped structure. The flanges 144 and 146 are again formed with openings 145 in alignment with the lance cut and spaced from the adjacent edges of the flanges to provide a central portion of the flanges with sufficient stiffening extending past the bend line 143*a* of the lance cut 143.

In this embodiment, the splice plate can also be used to interconnect abutting ends of curved trim strips to allow the installation of the splice plate 141 within curved trim strips. The flanges 144 and 146 are formed with lateral notches 147 at regular intervals along their length to provide spaced flange segments 147*a*. This allows the face portion to be bent at intervals along its length spaced from the lance cut to approximate the curvature of an associated curved trim strip. Adjacent to each lateral notch 147, an adjacent corner of each segment 147*a* is bent outwardly at 148 to form a locking point engagement with the hem of a curved trim strip. The notches 147 have a width which spaces adjacent segments 147*a*. Therefore, the two ends of the splice plate can be bent inwardly or outwardly to conform with either concave or convex trim strips which are interconnected by the splice plate.

Figure 22:
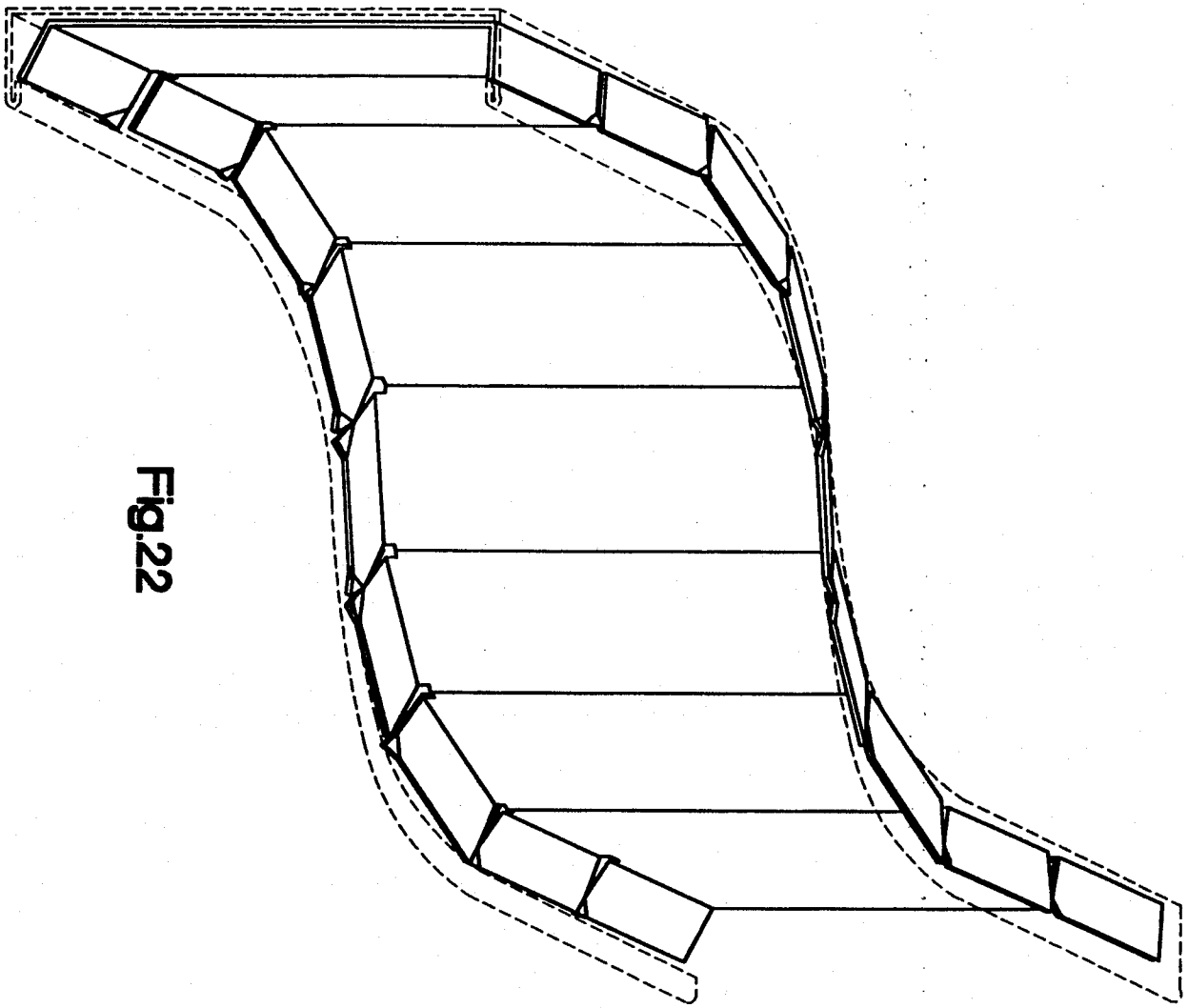
FIG. 22 is a side elevation of a second embodiment of splice plate which may be used to interconnect curved trim strips in either aligned condition or at an inside corner.
Figures 22, 23, 24, 25:
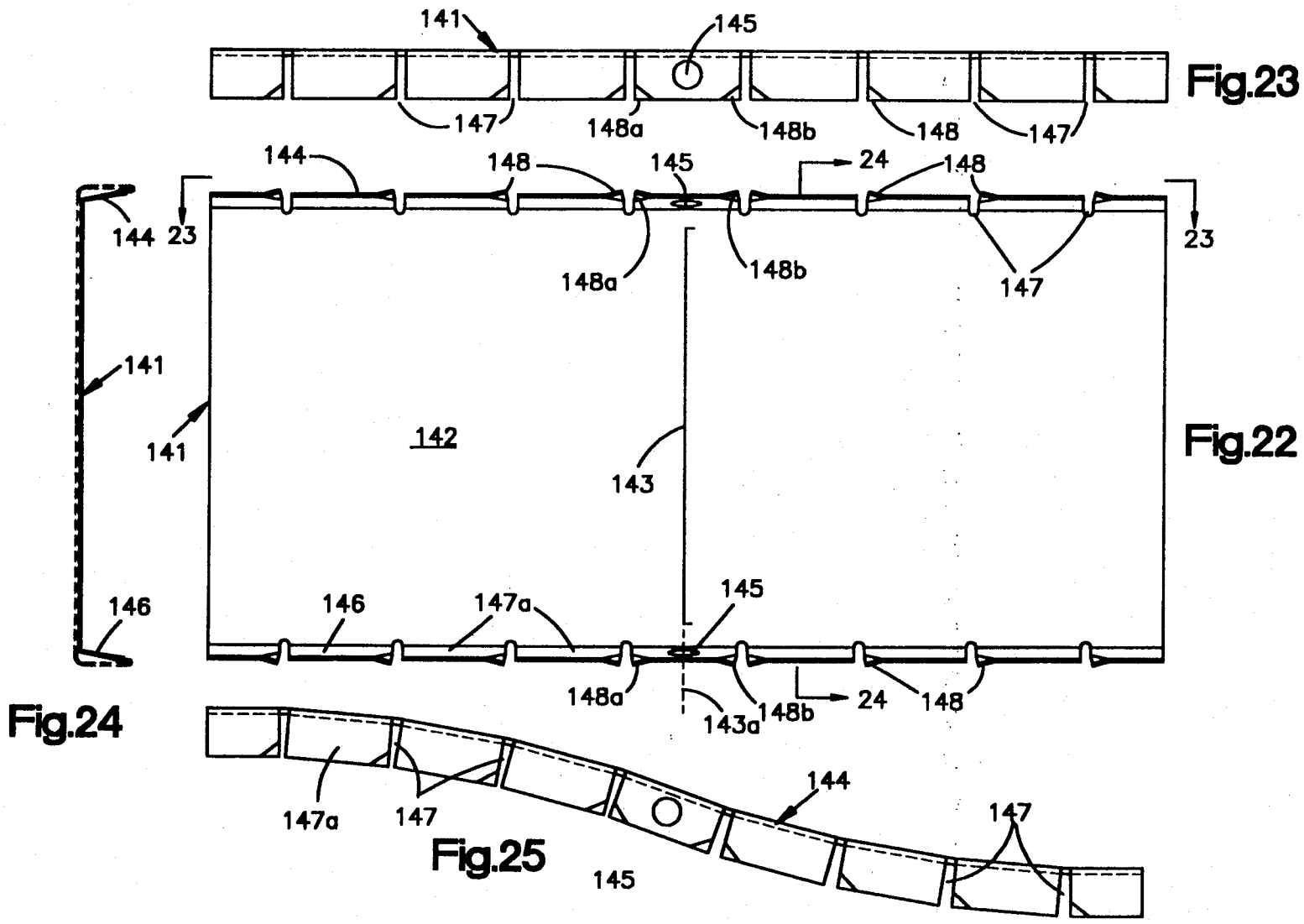
FIG. 23 is a section taken along 23—23 of FIG. 22.
FIG. 24 is a section taken along 24—24 of FIG. 22 with a trim strip illustrated in phantom mounted thereon.
FIG. 25 illustrates the installation of a splice plate of FIGS. 22-24 curved to inter-connect curved trim strips.

Here again, the splice plate can be used, as illustrated in FIGS. 22–24, to provide a bridging connection between abutting curved trim strips. When an inside corner must be formed, the portion of the flange beyond the opening 146 is again cut to allow the splice plate to be bent along the bend line formed by the lance cut 143 to form a sharp corner. Therefore, the splice plate can be used to interconnect curved or straight trim strips which are in substantial alignment where they abut, or can also be used to join curved trim strips at sharp inside corners.

The edges adjacent to the notches on either side of the openings 46 are both angled up to form locking corners on either side of the openings 146. However, the remaining flange segments between the notches 147 are bent up only at one corner so that each flange segment only locks with the adjacent flange of a curved trim strip at one point. This provides a good interconnection, even though the splice plate is not smoothly curved to conform to the curvature of the trim strip, but is only bent to approximate the curvature of the trim strip. By providing the central segment with two corner tabs 148*a* and 148*b*, however, the abutting ends are locked into alignment adjacent to the abutting ends, and a good alignment is achieved.

FIG. 24 illustrates the splice plate 141 bent to connect curved trim strips in which one end of the splice plate is bent to a concave shape to approximate the curvature of a curved trim strip, and the other end is bent to a convex shape to approximate the curvature of the other trim strip.

In each of the illustrated mounting clip embodiments, the mounting clip is first mounted on the associated grid tee and the trim strip is thereafter installed by merely snapping it into the mounted position on the mounting clip. Because there are no fasteners required to connect the trim strip to the mounting clips, there are no exposed fasteners which could detract from the finished appearance of the installation. Further, because the mounting clips can be easily installed to support trim strips extending in substantially any direction relative to the associated grid tee proper, trim can be provided for edges of substantially any shape.

Although the preferred embodiments of this invention have been shown and described, it should be understood that various modifications and rearrangements of the parts may be resorted to without departing from the scope of the invention as disclosed and claimed herein.

What is claimed is:

1. A splice plate for connecting elongated channel-shaped suspension ceiling members, said splice plate comprising a channel-shape body having a central planar face portion and opposed flanges proportioned to bridge between and lock with abutting ends of said channel-shaped members adjacent to said abutting ends thereof, said face portion providing means producing a bend line when said splice plate is bent to provide an inside corner, said flanges providing continuous portions extending uninterrupted past said bend line and maintaining said splice plate straight past said bend line when said splice plate interconnects aligned and abutting channel-shaped members, said continuous portion being severed permitting bending of said splice plate along said bend line when said splice plate interconnects channel-shaped members abutting at an inside corner.

2. A splice plate as set forth in claim 1, wherein said face portion has a width, said means producing said bend line is a lance cut extending along said bend line, said lance cut having a length less than said width, parts of said face portion extending uninterrupted past said bend line and cooperating with said continuous portions of said flanges to maintain said splice plate straight past said bend line when said splice plate interconnects aligned abutting channel-shaped members.

3. A splice plate as set forth in claim 2, wherein said flanges provide flange means spaced from said bend line permitting the splice plate on each side of said bend line to be bent to approximate the curvature of curved channel-shaped members when connecting abutting curved channel-shaped members.

4. A splice plate as set forth in claim 3, wherein said flange means provide a plurality of lateral notches at intervals spaced from said hinge line, said notches allowing said splice plate to be bent at intervals to approximate the curvature of curved channel-shaped members.

5. A splice plate as set forth in claim 4, wherein said notches separate said flanges into segments, said segments providing a corner bent to provide a locking point contact with said channel-shaped members.

6. A splice plate as set forth in claim 2, wherein said flanges each provide an opening aligned with said bend line spaced from the edge of the associated flange remote from said face portion.

7. A splice plate as set forth in claim 6, wherein said continuous portions of said flanges extend past said bend line between each opening in the associated edge of the associated flange, said continuous portion being cut when said splice plate is bent to provide an inside corner.

8. A splice plate for channel-shaped suspension ceiling trim strips comprising a planar face portion having opposed and parallel first and second face edges, a flange extending laterally with respect to said face portion from each of said edges and cooperating with said face portion to form a channel-shaped splice plate, each flange providing an opening aligned with the opening in the other flange, said openings being spaced from the flange edges of the associated flange remote from said face portion so that said flange provides a continuous portion extending past the associated opening resisting bending of said splice plate, said face portion providing a bend means aligned with said openings establishing a bend line, said splice plate being proportioned to fit into the aligned ends of said trim strips and maintain said ends in abutting alignment, said splice plate also operating to interconnect ends of trim strips abutting at inside corners when said continuous portion is cut and said splice plate is bent along a bend line to an angle matching the angle of said inside corner.

9. A splice plate as set forth in claim 8, wherein said bend means is a lance cut terminating at ends spaced from said edges.

10. A splice plate for connecting elongated curved channel-shaped suspension ceiling members, said splice plate comprising a planar face portion and opposed flanges proportioned to nest within and bridge between abutting ends of said curved ceiling members, said flanges providing lateral notches at intervals along their length permitting said splice plate to be bent at intervals to approximate the curvature of said curved ceiling members, said splice plate operating to lock abutting curved ceiling members together in proper abutting relationship.

11. A splice plate as set forth in claim 10, wherein said notches separate said flanges into segments having corners bent to provide locking point contact with said curved ceiling members.

12. A suspension ceiling comprising a grid having exposed edges, channel-shaped trim strips mounted on said grid concealing said edges, said trim strips providing abutting ends, and splice plates bridging said ends maintaining said trim strips in proper abutting engagement, said splice plates having a channel-shape including a face portion and opposed lateral flanges sized to nest within and lock with respect to said trim strips adjacent said abutting ends, said face portion providing bend means for establishing a bend line, said flanges providing continuous portions extending past said bend line preventing bending along said bend line when said splice plate interconnects aligned abutting ends of said trim strip, said continuous portion being separated allowing bending along said bend line when connecting abutting trim strips at an inside corner.

13. A suspension ceiling comprising a grid having exposed edges, curved channel-shaped trim strips mounted on said grid concealing said edges, said trim strips providing abutting ends, and splice plates bridging said ends and maintaining said trim strips in proper abutting engagement, said splice plates having a channel-shape including a face portion and opposed lateral flanges sized to nest within and lock with said trim strips adjacent said abutting ends, said flanges providing notches at intervals along their length allowing said splice plate to be bent at intervals to approximate the curvature of said curved channel-shaped members, said notches separating said flanges into segments, said segments providing a corner bent to provide locking point contact with said channel-shaped members.

14. A suspension ceiling as set forth in claim 13, wherein said segments are spaced by said notches to allow said splice plate to bend to a convex and a concave shape.

* * * * *